US008991777B2

(12) United States Patent
Madril

(10) Patent No.: US 8,991,777 B2
(45) Date of Patent: Mar. 31, 2015

(54) POST STABILIZATION APPARATUS AND METHOD

(71) Applicant: Gabriel Madril, Mohave Valley, AZ (US)

(72) Inventor: Gabriel Madril, Mohave Valley, AZ (US)

( * ) Notice: Subject to any disclaimer, the term of this patent is extended or adjusted under 35 U.S.C. 154(b) by 0 days.

(21) Appl. No.: 13/868,408

(22) Filed: Apr. 23, 2013

(65) Prior Publication Data

US 2014/0311083 A1 Oct. 23, 2014

(51) Int. Cl.
*E04H 12/20* (2006.01)
*E04H 12/22* (2006.01)
*E04H 12/34* (2006.01)

(52) U.S. Cl.
CPC ..... *E04H 12/2276* (2013.01); *E04H 12/347* (2013.01); *E04H 12/2292* (2013.01); *Y10S 52/04* (2013.01)
USPC ..... 248/206.5; 52/DIG. 4; 52/170; 52/127.2; 52/152

(58) Field of Classification Search
USPC ..... 52/DIG. 4, 165, 170, 127.2, 146, 152; 248/206.5, 545, 156, 530, 683; 269/8
See application file for complete search history.

(56) References Cited

U.S. PATENT DOCUMENTS

| | | | | |
|---|---|---|---|---|
| 877,268 | A | 1/1908 | Van Buren et al. | |
| 3,077,035 | A * | 2/1963 | Hackney | 33/293 |
| 3,154,833 | A * | 11/1964 | Kimball | 249/219.1 |
| 4,317,552 | A * | 3/1982 | Weidler | 248/168 |
| 4,438,896 | A * | 3/1984 | Hall | 248/523 |
| 4,889,322 | A | 12/1989 | Wagner | |
| 5,042,780 | A | 8/1991 | Yearwood | |
| 5,192,055 | A | 3/1993 | Griggs et al. | |
| 5,435,509 | A * | 7/1995 | Bingham | 248/159 |
| 5,769,370 | A * | 6/1998 | Ashjaee | 248/181.1 |
| 5,956,906 | A | 9/1999 | Berich et al. | |
| 6,029,407 | A * | 2/2000 | Schillero, Jr. | 52/127.2 |
| 6,217,170 | B1 * | 4/2001 | Hsiao | 351/153 |
| 6,425,560 | B1 * | 7/2002 | Dembowiak et al. | 248/206.5 |
| 6,663,073 | B1 * | 12/2003 | Church | 248/458 |
| 7,188,821 | B2 | 3/2007 | Curtis | |
| 7,350,541 | B2 * | 4/2008 | Kobetsky | 137/854 |
| 7,377,020 | B1 | 5/2008 | Bartling et al. | |
| 7,686,287 | B2 * | 3/2010 | Dixon et al. | 269/75 |
| 7,993,107 | B2 * | 8/2011 | Gevers | 416/244 R |
| 8,272,605 | B2 * | 9/2012 | Fuchs | 248/166 |
| 8,534,620 | B2 * | 9/2013 | Zierer et al. | 248/168 |
| 8,616,335 | B1 * | 12/2013 | Mosier | 182/107 |
| 2002/0056792 | A1 * | 5/2002 | Ibrahim | 248/163.1 |
| 2004/0004168 | A1 * | 1/2004 | Crain et al. | 248/188.8 |
| 2009/0229191 | A1 * | 9/2009 | Petrov | 52/16 |
| 2010/0237223 | A1 * | 9/2010 | Kao | 248/688 |
| 2011/0198174 | A1 * | 8/2011 | Ollgaard | 188/378 |
| 2012/0001045 | A1 * | 1/2012 | Wang | 248/281.11 |
| 2013/0134268 | A1 * | 5/2013 | Wessells et al. | 248/125.8 |
| 2013/0146742 | A1 * | 6/2013 | Wessells et al. | 248/558 |
| 2014/0252196 | A1 * | 9/2014 | Abady | 248/447 |

* cited by examiner

*Primary Examiner* — Brent W Herring
(74) *Attorney, Agent, or Firm* — Howard M. Cohn; Daniel Cohn

(57) ABSTRACT

A post stabilization apparatus and method of operation for setting a post within a post hole formed in the ground. The post stabilization apparatus includes one or more braces to support the post, each of said braces having a first end adapted for being driven into the ground; each of the one or more braces having a bracket assembly pivotally secured adjacent to a second end of thereof; and each bracket assembly having a magnet to removably attach the bracket assembly to the post.

10 Claims, 4 Drawing Sheets

POST STABILIZATION APPARATUS AND METHOD

TECHNICAL FIELD OF THE INVENTION

The present invention relates generally to a post stabilization apparatus for setting a post within a post hole formed in the ground. More specifically, the present invention relates to a post stabilization apparatus including one or more braces to support the post, each having a bracket assembly, and each bracket assembly having a magnet to removably attach the bracket assembly to the post.

BACKGROUND OF THE INVENTION

Fences are in common use for defining property boundaries, for the containment of animals, for decorative purposes, and so on. It is a common chore for ranchers, farmers and homeowners to install fencing on their property. While fences take on a wide plurality of forms, a common type of fence is comprised of a plurality of spaced-apart, ground supported posts and a plurality of fence rails supported on the posts and which form a barrier. The posts are plumb and typically all of a common height. Over the centuries fence posts have been manufactured from a wide variety of materials including unprocessed sticks and tree limbs, various wooden configurations manufactured by conventional wood processing techniques, metal tubes formed from iron, steel, and other metals, etc.

Typically, a modern fence post is constructed of steel or other durable material. Such posts may be subjected to severe loads such as those resulting from cattle contacting fencing which results in bending of the fence posts to enable escape of stock. It may be necessary that corner posts and some fence posts have additional bracing against the tension of the fence, strung thereon or around the post to prevent collapse of the fence when the wire is tensioned as by an animal attempting to cross the boundary line. Bracing for the fence posts and corner fence posts must be solid if the fence wire is to maintain its tension over a period of time.

SUMMARY OF THE INVENTION

According to an embodiment of the present invention, there is disclosed a post stabilization apparatus for setting a post within a post hole formed in the ground. The post stabilization apparatus includes one or more braces to support the post, each of said braces having a first end adapted for being driven into the ground; each of the one or more braces having a bracket assembly pivotally secured adjacent to a second end of thereof; and each bracket assembly having a magnet to removably attach the bracket assembly to the post.

According to another embodiment of the present invention, a method of setting a post within a post hole formed in the ground is disclosed. The method includes driving one or more braces in an arrangement into ground which lies adjacent to the post hole, placing the post into the post hole in the center of the arrangement of the one or more braces; engaging the post with magnets disposed within an end wall of a bracket located on each of the one or more braces; temporarily stabilizing the post in an upright position; pouring a binder into the post hole around a base of the post; and removing the one or more braces from the ground adjacent to the post hole.

BRIEF DESCRIPTION OF THE DRAWINGS

The structure, operation, and advantages of the present invention will become further apparent upon consideration of the following description taken in conjunction with the accompanying figures (FIGs.). The figures are intended to be illustrative, not limiting. Certain elements in some of the figures may be omitted, or illustrated not-to-scale, for illustrative clarity. The cross-sectional views may be in the form of "slices", or "near-sighted" cross-sectional views, omitting certain background lines which would otherwise be visible in a "true" cross-sectional view, for illustrative clarity.

In the drawings accompanying the description that follows, both reference numerals and legends (labels, text descriptions) may be used to identify elements. If legends are provided, they are intended merely as an aid to the reader, and should not in any way be interpreted as limiting.

DETAILED DESCRIPTION OF THE PREFERRED EMBODIMENTS

Figure 1:
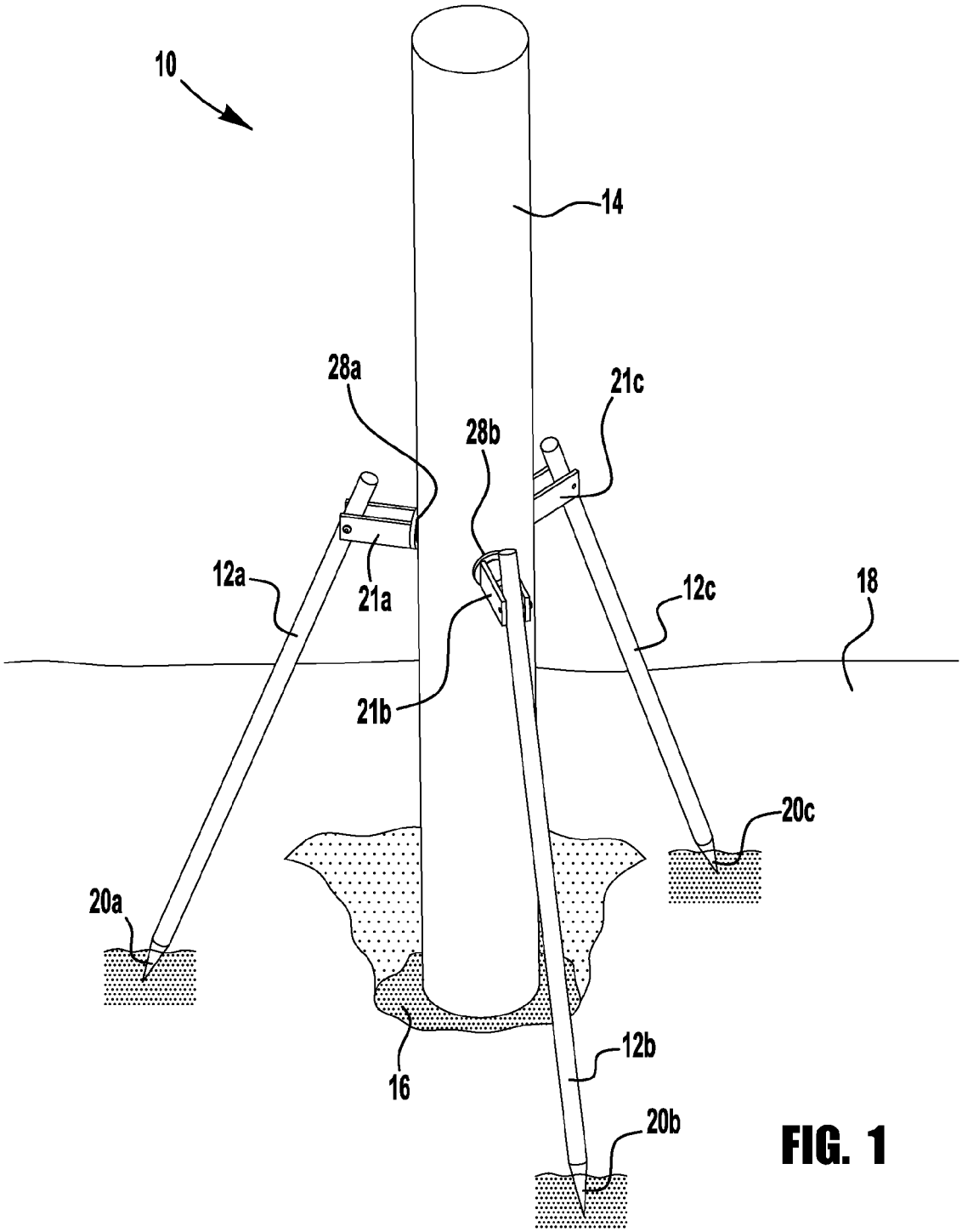
FIG. 1 is a front, three-dimensional view of a post stabilization apparatus, in accordance with the present invention.

In the description that follows, numerous details are set forth in order to provide a thorough understanding of the present invention. It will be appreciated by those skilled in the art that variations of these specific details are possible while still achieving the results of the present invention. Well-known processing steps are generally not described in detail in order to avoid unnecessarily obfuscating the description of the present invention.

In the description that follows, exemplary dimensions may be presented for an illustrative embodiment of the invention. The dimensions should not be interpreted as limiting. They are included to provide a sense of proportion. Generally speaking, it is the relationship between various elements, where they are located, their contrasting compositions, and sometimes their relative sizes that is of significance.

In the drawings accompanying the description that follows, often both reference numerals and legends (labels, text descriptions) will be used to identify elements. If legends are provided, they are intended merely as an aid to the reader, and should not in any way be interpreted as limiting.

Posts are a common feature of many favored structural assemblies in properties through the world. Structural posts constitute integral features of structures such as fences, gateposts, pet pens, trellises, and the like. The stability and long term usefulness of such items depends heavily upon the foundation used to support the vertical members or posts used with the item. As such, the stability of the installation of such members is of critical importance and great care is taken to ensure that such posts are adequately secured. By far the most common and age-old method of installing a fence post, is to dig an oversize hole, rest the post in the bottom of the hole and backfill around the latter, preferably with concrete. This is a time consuming and laborious operation, especially when it must be repeated over and over again every few feet.

FIG. 1 illustrates the post stabilization apparatus 10 for setting a fence post 14 within a post hole 16 formed in the ground 18. The post stabilization apparatus 10 may be utilized to install any type of post such as yard fence posts, gate posts, pet pen posts, tubes, or any other desired use. Typically, when a post (called a fence post herein) 14 is to be installed in the ground 18, a post hole 16 is first dug in the ground 18 and then the post is placed in the hole and plumbed into a desired position. A cement foundation is then poured around the fence post 14 to keep it in place.

Previously, installing a fence post 14, was typically a two-person operation. The post 14 is first set in the post hole 16, and the first person holds the post in place. Then, the second person pours cement into the post hole 16 a distance to cover the bottom of the post, and the first person continues to hold post 14 until the concrete sets and secures the post in place.

The post stabilization apparatus 10 of the present embodiment is designed to vastly improve the speed and ease of installing a plurality of fence posts 14 and allows a single person to permanently install the post 14. The post stabilization apparatus 10 includes one or more braces 12 and preferably three braces, such as braces 12*a*, 12*b*, and 12*c* (12*a*-12*c*) to temporarily support a fence post 14, during the installation of the post.

Figure 2:
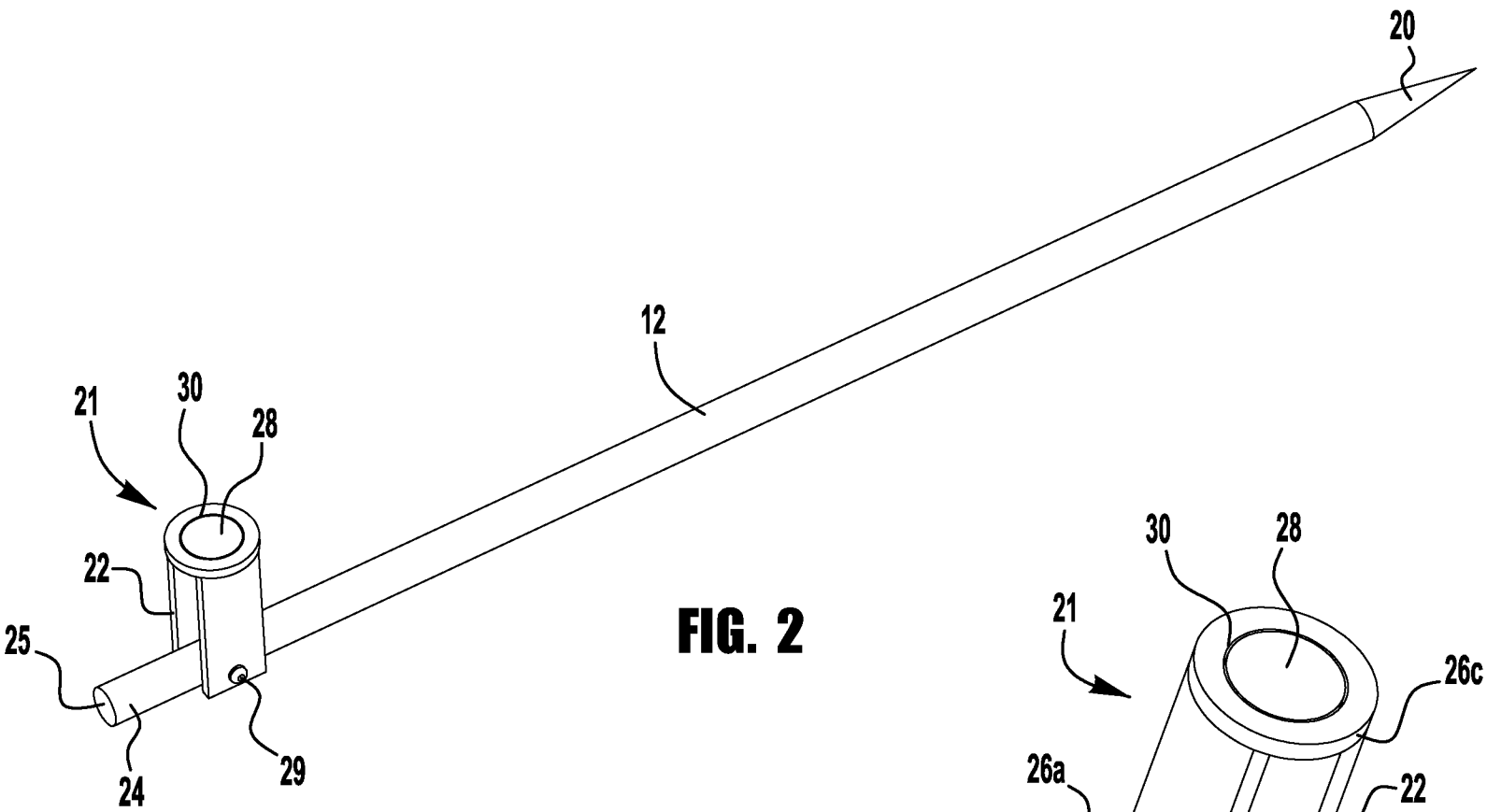
FIG. 2 is a front, three-dimensional view of a brace for use with the post stabilization apparatus, in accordance with the present invention.

Each of the braces 12*a*-12*b* have a first end 20, formed as a sharpened end 20*a*,20*b*,20*c* (20*a*-20*c*) respectively, adapted for allowing the braces to be driven into the ground 18 adjacent to the post hole 16. The braces 12*a*-12*c* may be constructed of any suitable material, preferably metal such as hardened steel or a hardened plastic polymer. The braces 12*a*-12*c* may be of any preferred dimensions, such as a length of between 36 inches to 48 inches and a diameter of between 0.75 inches to 1.0 inches. As seen in FIG. 2, the first end 20 of brace 12, which is designed to be driven into the ground 18, may be provided with a sharpened point to allow the brace to be easily driven into the ground 18. The post stabilization apparatus 10 is designed to temporarily support fence posts 14 with a variety of lengths and diameters. For example, the post stabilization apparatus 10 can support fence posts having a length of between about 36 inches and 48 inches, and a diameter of between about 36 inches and 120 inches.

Figure 3:
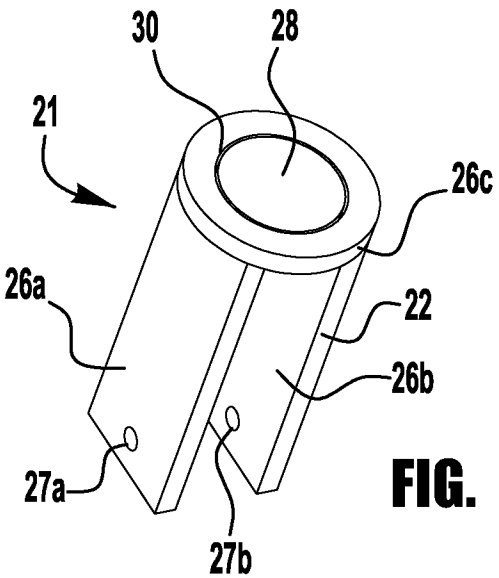
FIG. 3 is a close-up view of a bracket secured to the brace of the post stabilization apparatus, in accordance with the present invention.

As seen in FIGS. 2 and 3, there is a bracket assembly 21, designed to temporarily engage the fence post 14, mounted near a second end 24 of the brace 12. The bracket assembly 21 consists of a bracket 22 mounted to the brace 12 adjacent to a second end 24 of the brace. A magnet 28 is connected to the bracket 22 to removably attach the bracket assembly 21 to the fence post 14. As seen in FIG. 1, bracket assemblies 21*a*, 21*b*, and 21*c* each have a magnet 28 to temporarily attach the braces 12*a*-12*c*, respectively, and the fence post 14.

Bracket 22 is mounted to the brace 12 so as to be able to pivot about the second end 24 of the brace 12. Bracket 22 is typically constructed as a U-shaped bracket sized to accommodate a range of standardized post sizes. Bracket 22 consists of two sidewalls 26*a* and 26*b* joined at one end to an end wall 26*c*. The sidewalls 26*a*, 26*b* can be generally rectangular in shape and the end wall 26*c* can be cylindrical in shape. However, it is within the terms of the preferred embodiment that the sidewalls 26*a*, 26*b* and the end wall 26*c* can be of other shapes as desired.

A hole 27*a* and 27*b* is provided in sidewalls 26*a*, 26*b*, respectively, to receive a bolt 29. The bolt 29 goes through an opening (not shown) extending through brace 12 and pivotally secures the bracket 22 to the brace. The distance between the holes 27*a*, 27*b* and the underside of the end wall 26*c* is preferably greater than the distance between the second end 24 and the opening through the brace 12. In that way, the bracket 26 can comfortably clear the top end 25 of the second end 24 of brace 12, and allow the bracket to swing from one side of the brace to the other. It is also within the terms of the invention to connect bracket 22 to the brace 12, in any preferred manner, such as with a rivet so that it can pivot with respect to the brace.

The end wall 26*c* is adapted to receive a magnet 28, as seen in FIG. 3. End wall 26*c* has a cylindrical opening 30 therein which can either extend through the end wall or have a bottom to form a closed bore. Magnet 28 is a permanent magnet and is disposed in the cylindrical opening 30 of the end wall 26*c*. Magnet 28 is attached to the bracket 22 in any desired manner, such as force fitting the magnet into the cylindrical opening 30 in the end wall 26*c*, applying an adhesive to the magnet to adhere the magnet in the cylindrical opening 30, or providing a lip (not shown) about the cylindrical opening 30 of end wall 26*c* to fold over the magnet and secure the magnet in place. As discussed in more detail herein, the magnets 28*a*, 28*b*, and 28*c* (28*a*-28*c*) in brackets 22*a*-22*c*, respectively, are designed to engage the fence post 14*a*-14*c*, and secure the brackets 22*a*-22*c* of the brace 12*a*-12*c*, respectively, thereto.

Figure 4:
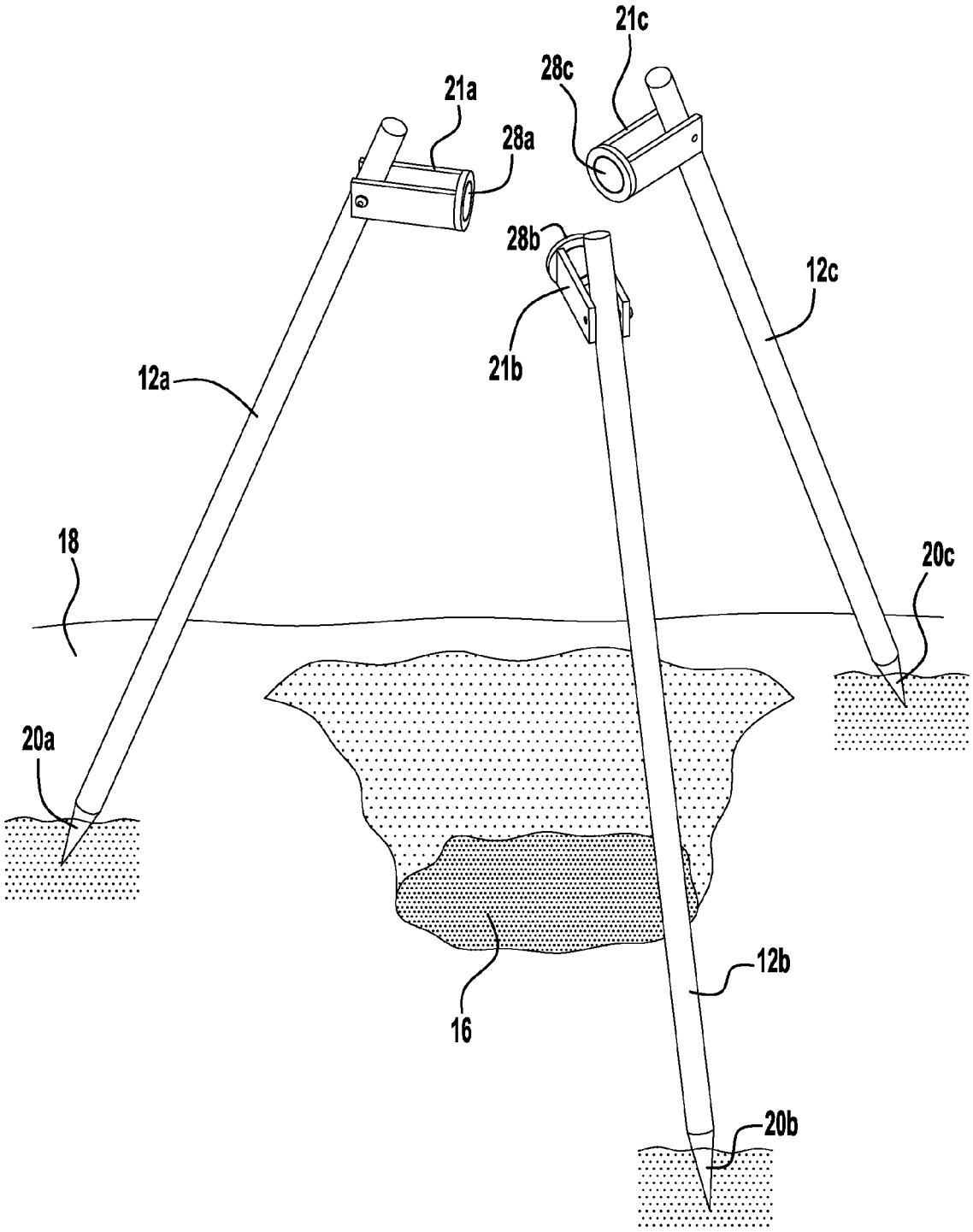
FIG. 4 is a front, three-dimensional view of three braces of the post stabilization apparatus, in accordance with the present invention.
Figure 5:
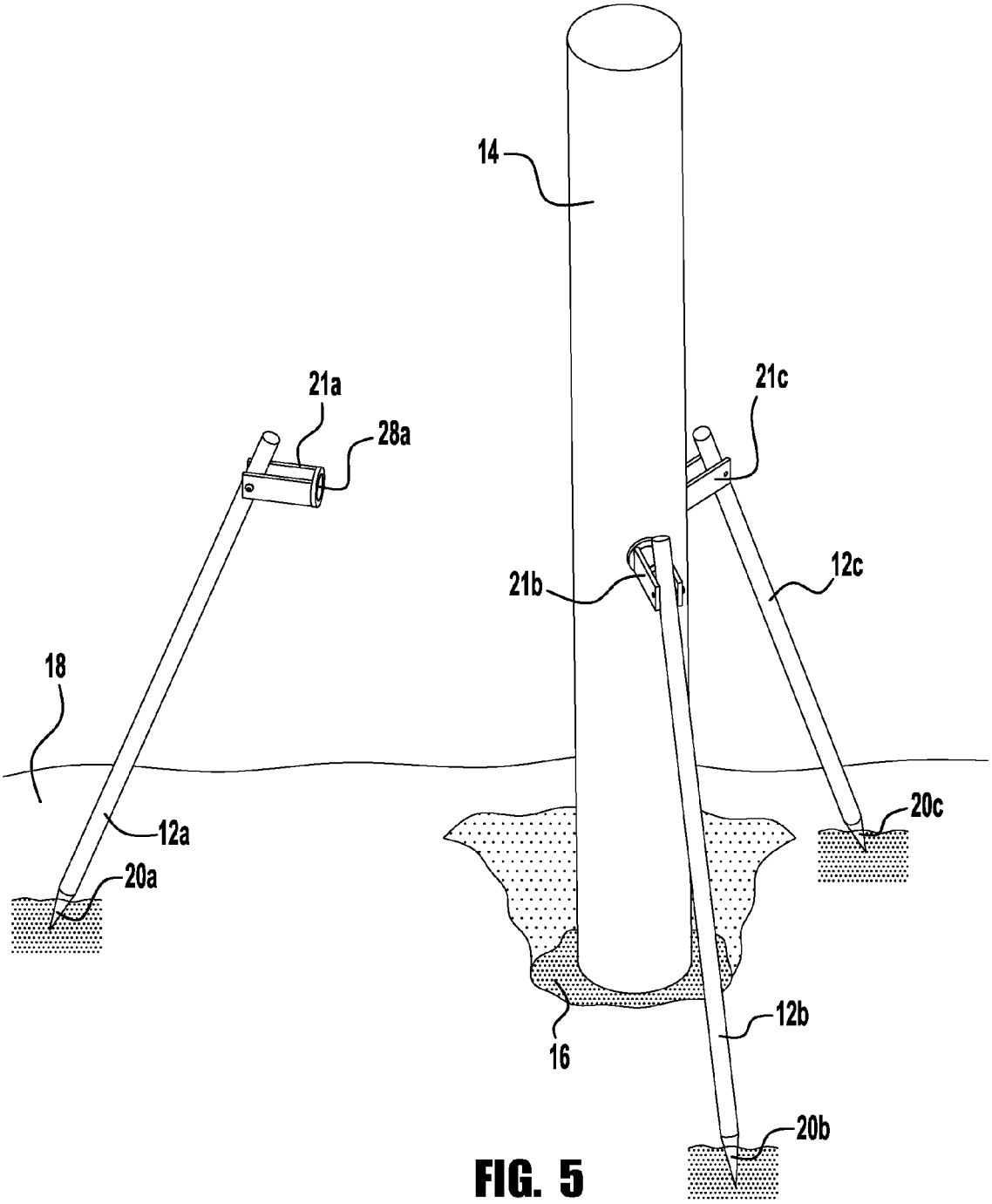
FIG. 5 is a front, three-dimensional view of three braces of the post stabilization apparatus with two of the braces supporting a post, in accordance with the present invention.

FIGS. 4 and 5 illustrate the method of employing post stabilization apparatus 10 to temporarily support a fence post 14, during the installation of the fence post.

First, as seen in FIG. 4, the one or more braces 12*a*-12*c* are driven into the ground 18, which lies adjacent to the post hole 16, into which the post 14 will be mounted. The one or more braces 12*a*-12*c* may be driven into the ground 18 in any fashion, such as with a hammer or mallet, so that they can stand independently. Further, braces 12*a*-12*c* may be arranged in any desired fashion, such as a tripod shape, around the post hole 16. Post stabilization system 10 operates regardless of whether the ground 18 is uneven and/or at different levels.

After the braces 12*a*-12*c* have been driven into the ground 18, the fence post 14 is placed into the post hole 16, in the center of the arrangement of braces as shown in FIG. 5. The brackets 22*a*-22*c* of the braces 12*a*-12*c* are rotated or pivoted about the top end 25 of brace 12 (if necessary), to engage the fence post 14 with the magnets 28 within the end wall 26*c* of the brackets 22 in contact with the fence post. While it is preferable to use three braces 12*a*-12*c*, it is within the terms of the preferred embodiment to use one or two braces and in some cases more than three braces. Once each of the bracket assemblies 21*a*-21*c* are engaged with the fence post 24, the fence post is temporarily stabilized in an upright position.

As further seen in FIG. 5, the magnets 28*a* and 28*b* on the ends of the brackets 22*a* and 22*b* mounted to braces 12*a* and 12*b*, respectively, are engaged to the post 14, and the magnet 28*c* on the end of bracket 22*c* mounted to brace 12*c* is about to engage the post.

After the magnets 28*a*-28*c* on the brackets 22*a*-22*c* are secured, and the braces 12*a*-12*c* are engaged to the post 14, the post 14 is temporarily supported in place. Then, if desired, any of the braces 12*a*-12*c* may be adjusted as to plumb the fence post 14. This may be accomplished by utilizing a level against the fence post 14 and then, if needed, any of the braces 12*a*-12*c* may be driven further into the ground until the fence post is completely plumb.

After the post stabilization apparatus 10 is engaged with the fence post 14, as seen in FIG. 1, with the braces 12*a*-12*c* placed around the post hole 16, and their sharpened ends 20*a*-20*c* driven into the ground 18, the braces are temporarily secured to the fence post 14 utilizing magnets 28 of brackets 22*a*, 22*b*, and 22*c* (22*a*-22*c*), respectively. The magnets 28 temporarily secure join the brackets 22*a*-22*c* with the fence post 14, and the braces 12*a*-12*c* support the fence post. With the post 14 standing securely in place, a binder, such as cement, is poured into the hole 16, around the base of the post.

Once the cement has set, the braces 12*a*-12*c* may be removed. Now, the post 14 has been permanently mounted and the post stabilization apparatus 10 may be used to install another post.

Although the invention has been shown and described with respect to a certain preferred embodiment or embodiments, certain equivalent alterations and modifications will occur to others skilled in the art upon the reading and understanding of this specification and the annexed drawings. In particular regard to the various functions performed by the above described components (assemblies, devices, etc.) the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application.

The invention claimed is:

1. A post stabilization apparatus for setting a post within a post hole formed in the ground, comprising:

three detached braces to support the post, each of said braces having a sharpened first end adapted for being driven into the ground;

each of the three detached braces having a separate bracket assembly pivotally secured adjacent to a second end thereof; and each bracket assembly having a magnet to removably attach the bracket assembly to the post.

2. The stabilization apparatus of claim 1 wherein each separate bracket assembly consists of a bracket pivotally mounted adjacent to the second end of one of the three detached braces.

3. The stabilization apparatus of claim 2 wherein each bracket is pivotally mounted to the second end of one of the three detached braces so as to be able to pivot about the second end of each of the three detached brace and allow the bracket to swing from one side of the detached brace to the other side of the detached brace.

4. The stabilization apparatus of claim 3 wherein each bracket consists of two sidewalls joined at one end to an end wall.

5. The stabilization apparatus of claim 4 wherein each bracket contains holes in the sidewalls to receive a bolt, said bolt going through an opening extending through each of the three detached braces to pivotally secure the bracket to one of the three detached braces.

6. The stabilization apparatus of claim 5 wherein a first distance between the holes in the sidewalls and an underside of the end wall of the bracket is greater than a second distance between the second end and the opening through each of the three detached braces.

7. The stabilization apparatus of claim 4 wherein the end wall has a cylindrical opening therein which can either extend through the end wall or have a bottom to form a closed bore, and the magnet is disposed in the cylindrical opening of the end wall.

8. The stabilization apparatus of claim 7 wherein the magnet is attached to the bracket by force fitting the magnet into the cylindrical opening in the end wall.

9. The stabilization apparatus of claim 7 wherein the magnet is attached to the bracket by applying an adhesive to the magnet to adhere the magnet in the cylindrical opening in the end wall.

10. The stabilization apparatus of claim 1 wherein each of the three detached braces has a sharpened point at the first end.

* * * * *